US009033452B2

(12) United States Patent
Takada

(10) Patent No.: US 9,033,452 B2
(45) Date of Patent: May 19, 2015

(54) EJECTION DETECTION DEVICE, EJECTION DETECTION METHOD, AND PRINTING APPARATUS

(71) Applicant: CANON FINETECH INC., Misato-shi (JP)

(72) Inventor: Shingo Takada, Toda (JP)

(73) Assignee: CANON FINETECH INC., Misato-Shi (JP)

( * ) Notice: Subject to any disclaimer, the term of this patent is extended or adjusted under 35 U.S.C. 154(b) by 0 days.

(21) Appl. No.: 14/193,511

(22) Filed: Feb. 28, 2014

(65) Prior Publication Data

US 2014/0240390 A1 Aug. 28, 2014

(30) Foreign Application Priority Data

Feb. 28, 2013 (JP) ..... 2013-039471
Feb. 17, 2014 (JP) ..... 2014-027874

(51) Int. Cl.

| | |
|---|---|
| ***B41J 29/393*** | (2006.01) |
| ***B41J 29/00*** | (2006.01) |
| ***B41J 2/165*** | (2006.01) |
| ***B41J 2/125*** | (2006.01) |
| ***B41J 2/21*** | (2006.01) |

(52) U.S. Cl.

CPC ..... *B41J 29/00* (2013.01); *B41J 2/16579* (2013.01); *B41J 2/125* (2013.01); *B41J 2/2142* (2013.01)

(58) Field of Classification Search

CPC ..... B41J 2/16579; B41J 2/04558; B41J 2/165
USPC ..... 347/14, 19, 5, 9, 20, 44, 47
See application file for complete search history.

(56) References Cited

U.S. PATENT DOCUMENTS 7,108,347 B2 * 9/2006 Miyashita ..... 347/19
7,815,278 B2 * 10/2010 Unosawa et al. ..... 347/19

FOREIGN PATENT DOCUMENTS

JP 2006-007447 A 1/2006
JP 2010-253771 A 11/2010

* cited by examiner

*Primary Examiner* — Juanita D Jackson
(74) *Attorney, Agent, or Firm* — Fitzpatrick, Cella, Harper & Scinto

(57) ABSTRACT

The objective of the present invention is to provide an ejection detection device with an inexpensive and simple structure that can appropriately detect conditions of nozzles, without the control of the quantity of liquid ejected from the nozzles being required. Therefore, for the ejection detection device of the present invention, a light-emitting unit emits light to a light-receiving unit in a direction in which a plurality of nozzles is arranged in a print head. The ejection detection device detects the condition of a nozzle to be detected, which ejects the liquid droplet. At this time, the emission intensity of the light-emitting unit or the responsivity of the light-receiving unit is controlled by the print head in accordance with the location of the nozzle to be detected.

9 Claims, 15 Drawing Sheets

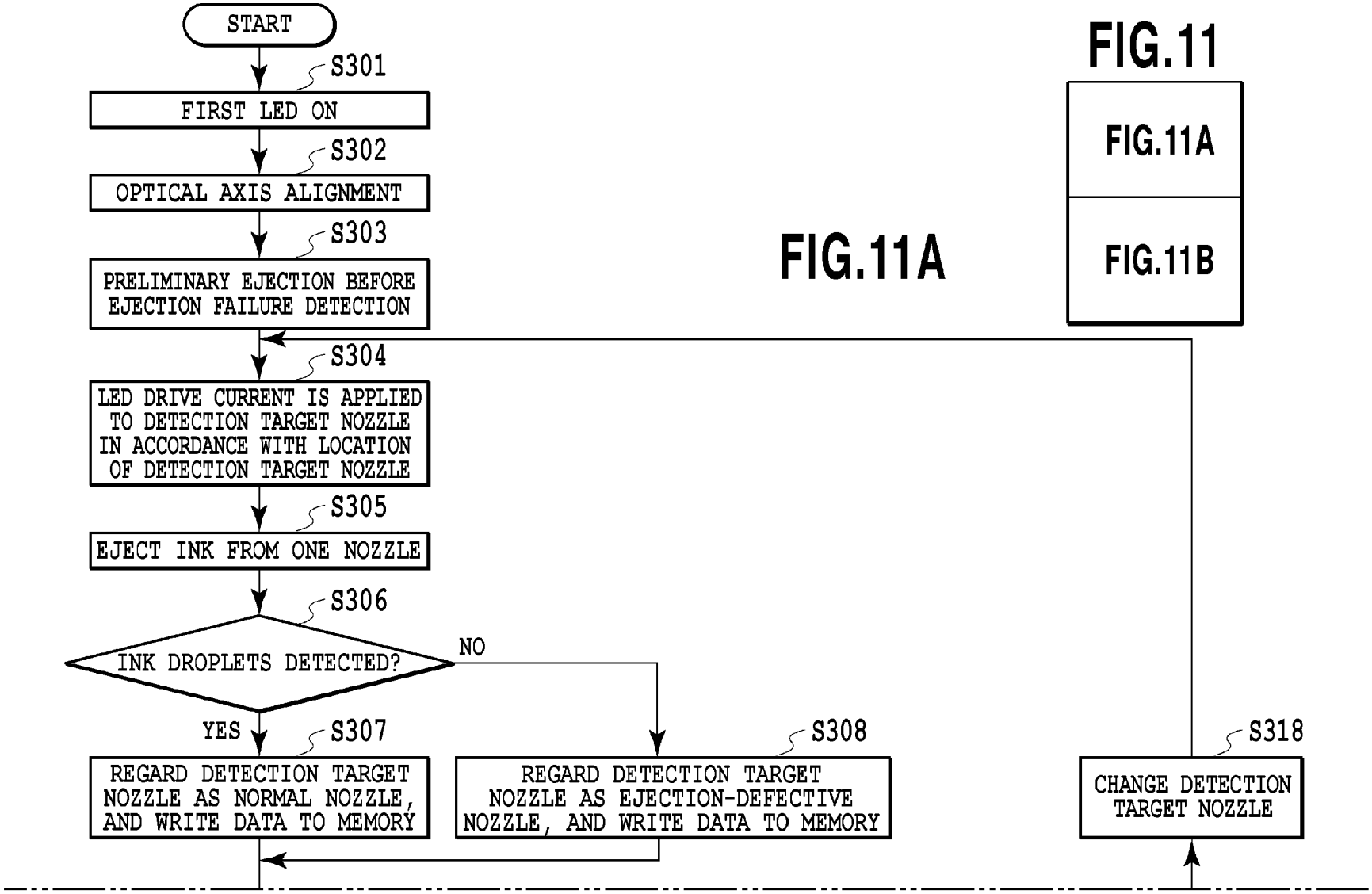
FIG.11
FIG.11A
FIG.11B
FIG.11A
START
S301
FIRST LED ON
S302
OPTICAL AXIS ALIGNMENT
S303
PRELIMINARY EJECTION BEFORE EJECTION FAILURE DETECTION
S304
LED DRIVE CURRENT IS APPLIED TO DETECTION TARGET NOZZLE IN ACCORDANCE WITH LOCATION OF DETECTION TARGET NOZZLE
S305
EJECT INK FROM ONE NOZZLE
S306
INK DROPLETS DETECTED?
NO
YES
S307
REGARD DETECTION TARGET NOZZLE AS NORMAL NOZZLE, AND WRITE DATA TO MEMORY
S308
REGARD DETECTION TARGET NOZZLE AS EJECTION-DEFECTIVE NOZZLE, AND WRITE DATA TO MEMORY
S318
CHANGE DETECTION TARGET NOZZLE

EJECTION DETECTION DEVICE, EJECTION DETECTION METHOD, AND PRINTING APPARATUS

BACKGROUND OF THE INVENTION

1. Field of the Invention

The present invention relates to an ejection detection device and an ejection detection method for detecting the nozzle condition, such as an ejection failure, for a liquid ejection head where a plurality of nozzles are arranged to eject a liquid, and a printing apparatus that employs this ejection detection device.

2. Description of the Related Art

A liquid ejection printing apparatus ejects, to a printing medium, liquid droplets, such as ink droplets, from a plurality of nozzles provided for a liquid ejection head, and prints images. Therefore, the ejection conditions of the individual nozzles of the liquid ejection head have a great effect on the quality of an image. For maintaining the quality of printed images, the liquid ejection printing apparatus employs an ejection detection device that detects the condition wherein liquid droplets were ejected from the individual nozzles, and periodically examines the ejection of liquid droplets to detect the conditions of the nozzles, such as ejection failure.

An example ejection detection device includes: a light-emitting device (LED) that serves as a light-emitting unit for emitting detection light that intersects the flight path of liquid droplets; and a light-receiving device (photodiode) that serves as a light-receiving unit for receiving the detection light. This ejection detection device detects a change in the quantity of light received by the light-receiving device when the ejected liquid droplets have passed the optical path, and determines the presence/absence of an ejection-defective nozzle. That is, a timing at which liquid droplets were ejected and a timing at which the change of the light quantity caused by the interception of light by liquid droplets was detected by the light-receiving device can be employed to determine the passage of liquid droplets, i.e., to determine the presence/absence of an ejection-defective nozzle.

Since all the nozzles of the nozzle array of the liquid ejection head should be settled within the range of the path of detection light formed by the light-emitting device and the light-receiving device, the distance between these devices is extended as the number of nozzles is increased. Therefore, from the viewpoint of reducing space required by a detection mechanism, the light-emitting device and the light-receiving device are arranged at the smallest distance in which the nozzle array can be settled.

Meanwhile, since the detection light rays emitted by the light-emitting device are diverging light rays, the rays intercepted by liquid droplets that were ejected by the nozzles near the light-emitting device are easily affected by optical diffraction. Therefore, according to a correlation between the distance from the nozzles to the light-emitting device and the optical diffraction, the change of the received light quantity that occurs depending on whether ink droplets were ejected tends to be reduced when the nozzles are located near the light-emitting device because the rays to be intercepted by liquid droplets reach the light-receiving device because of diffraction. Furthermore, since the radiant intensity of light is reduced inversely proportionally to the square of the distance, the quantity of light tends to decrease and the quantity of light received by the light-receiving device tends to be reduced, regardless of whether liquid droplets were ejected, when the nozzles are located a distance from the light-emitting device. As shown in FIG. 14 that is a schematic diagram showing a relationship between the locations of nozzles of a conventional ejection detection device and a received photocurrent, since the change of the received light quantity that occurs depending on whether liquid droplets were ejected is reduced for the nozzles located nearer the light-emitting device (LED), the value of the detection output that corresponds to the change of the quantity of received light is gradually lowered. The detection output value indicating a change in the quantity of received light as described above is also gradually reduced for the ejection nozzles located a longer distance from the light-emitting device (or closer to the light-receiving device).

As described above, the detection output level of the light-receiving device greatly differs depending on the locations of nozzles, from which a liquid droplet to be detected is ejected, i.e., a location near the light-emitting device, a location that is far from the light emitting device and that is near the light-receiving device, and an intermediate location, and there is a problem that uniform and stable detection cannot be performed for all of the nozzles.

In order to resolve this problem, a technique for optically detecting the ejection conditions of liquid droplets is disclosed in Japanese Patent Laid-Open No. 2006-007447. According to this technique, a large number of droplets are ejected from the nozzles near the light emission side, while a small number of droplets are ejected from the nozzles near the light reception side, so that almost the same detection output level is obtained at the time of detection for ink droplets. Further, the technique for an ejection failure detection unit employing a laser system is disclosed in Japanese Patent Laid-Open No. 2010-253771, whereby the diameter of ink droplets to be ejected is increased based on the distance between nozzles and a sensor.

However, there is a problem for the techniques in Japanese Patent Application laid-open No. 2006-007447 and Japanese Patent Application Laid-open No. 2010-253771 that the structure that controls the number of ejected droplets or the diameter of droplets only for detection must be prepared, and there is another problem that more consumption of liquid that does not contribute into printing is required. Moreover, since the number of droplets to be ejected or the diameter of an ink droplet employed for the detection process differ from those employed for the actual printing process, the number of ejected droplets or the diameter of the droplets are reduced in the actual printing although ejection of ink droplets was normally performed during the process of detecting ejection conditions, and therefore, there is possibility that an ejection failure will occur when energy to be supplied to the printing elements (heaters or piezoelectric elements) of the individual nozzles is reduced.

SUMMARY OF THE INVENTION

The objective of the present invention is to provide an ejection detection device and a detection method, whereby an inexpensive and simple structure is employed to appropriately detect the conditions of nozzles, such as ejection failure, without control of the number of a liquid droplets or the diameter of the droplets to be ejected from the nozzles being required, and a printing apparatus that employs the ejection detection device.

In order to achieve the objective, the present invention includes the following configuration.

That is, according to a first aspect of the present invention, an ejection detection device, which employs a light-emitting unit to emit light toward liquid droplet ejected from a plurality of nozzles, and based on a quantity of light received by a light-receiving unit when the ejected liquid droplet has passed the light, detects conditions of the nozzles, from which ink has been ejected, comprising: a control unit for controlling, in accordance with locations of the nozzles to be detected, an emission intensity of the light-emitting unit or a responsivity of the light-receiving unit.

According to a second aspect of the present invention, a detection method, whereby light is emitted by a light-emitting unit toward liquid droplets ejected from a plurality of nozzles, and based on the light received by a light-receiving unit, conditions of the nozzles, from which the liquid droplets have been ejected, are detected, comprising a step of: controlling, in accordance with locations of the nozzles to be detected, an emission intensity of the light-emitting unit or a responsivity of the light-receiving unit.

According to a third aspect of the present invention, a printing apparatus for forming an image on a printing medium by ejecting a liquid from a plurality of nozzles that are arranged in a print head, comprising: an ejection detection device according to claim 1.

According to the present invention, since the emission intensity of the light-emitting unit or the responsivity of the light-receiving unit is changed in accordance with the location of a nozzle, of a plurality of nozzles arranged for the liquid ejection head, from which a liquid droplet is ejected, the condition of the nozzle to be examined can be obtained by employing an inexpensive and simple structure, without controlling the number of a liquid droplet or a diameter of liquid droplet ejected from the nozzle.

Further features of the present invention will become apparent from the following description of exemplary embodiments (with reference to the attached drawings).

BRIEF DESCRIPTION OF THE DRAWINGS

FIG. 11 is a diagram showing the relationship of FIG. 11A and FIG. 11B;

FIG. 11A is a flowchart showing the ejection failure detection of a part of operations performed for the second embodiment;

DESCRIPTION OF THE EMBODIMENTS

The embodiments of the present invention will now be described in detail, while referring to drawings.

First Embodiment

Figure 1:
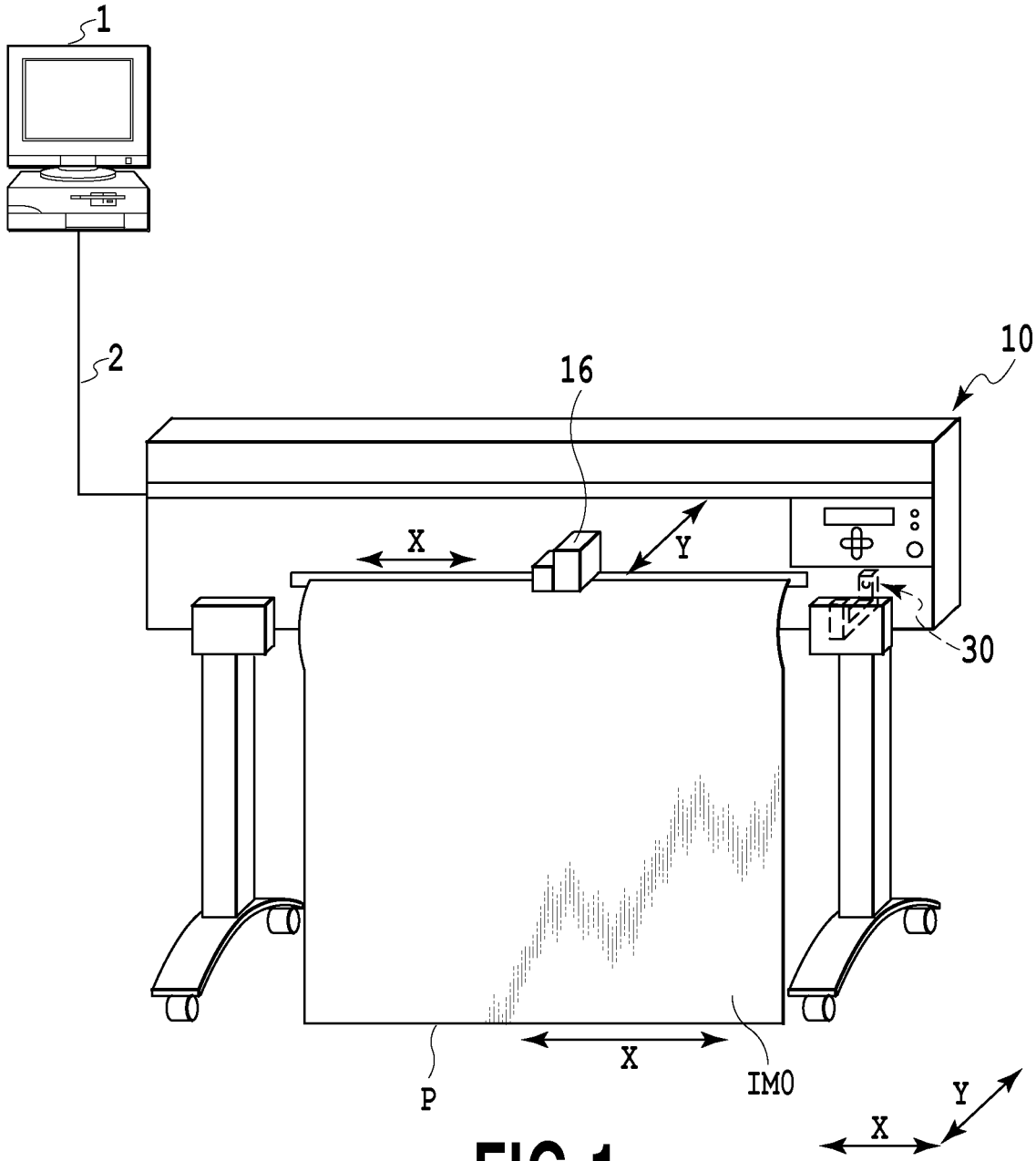
FIG. 1 is a diagram illustrating the external appearance of a printing apparatus according to a first embodiment of the present invention.

FIG. 1 is a perspective view of the external appearance of a printing apparatus according to a first embodiment of the present invention. In the description for this embodiment, a wide-format ink jet printing apparatus is employed as an example. A printing apparatus 10 is connected to an external apparatus, such as a personal computer (PC) 1 via a communication cable 2, and performs printing based on image data transmitted with a printing instruction by the external apparatus. Further, the printing apparatus 10 is a so-called serial printing apparatus that includes a conveying unit, for intermittently conveying a printing medium P in a sub-scan direction (Y direction), and a main scanning unit for reciprocally moving a print head 16 in a main scan direction (X direction) that intersects the sub-scan direction.

Figure 2:
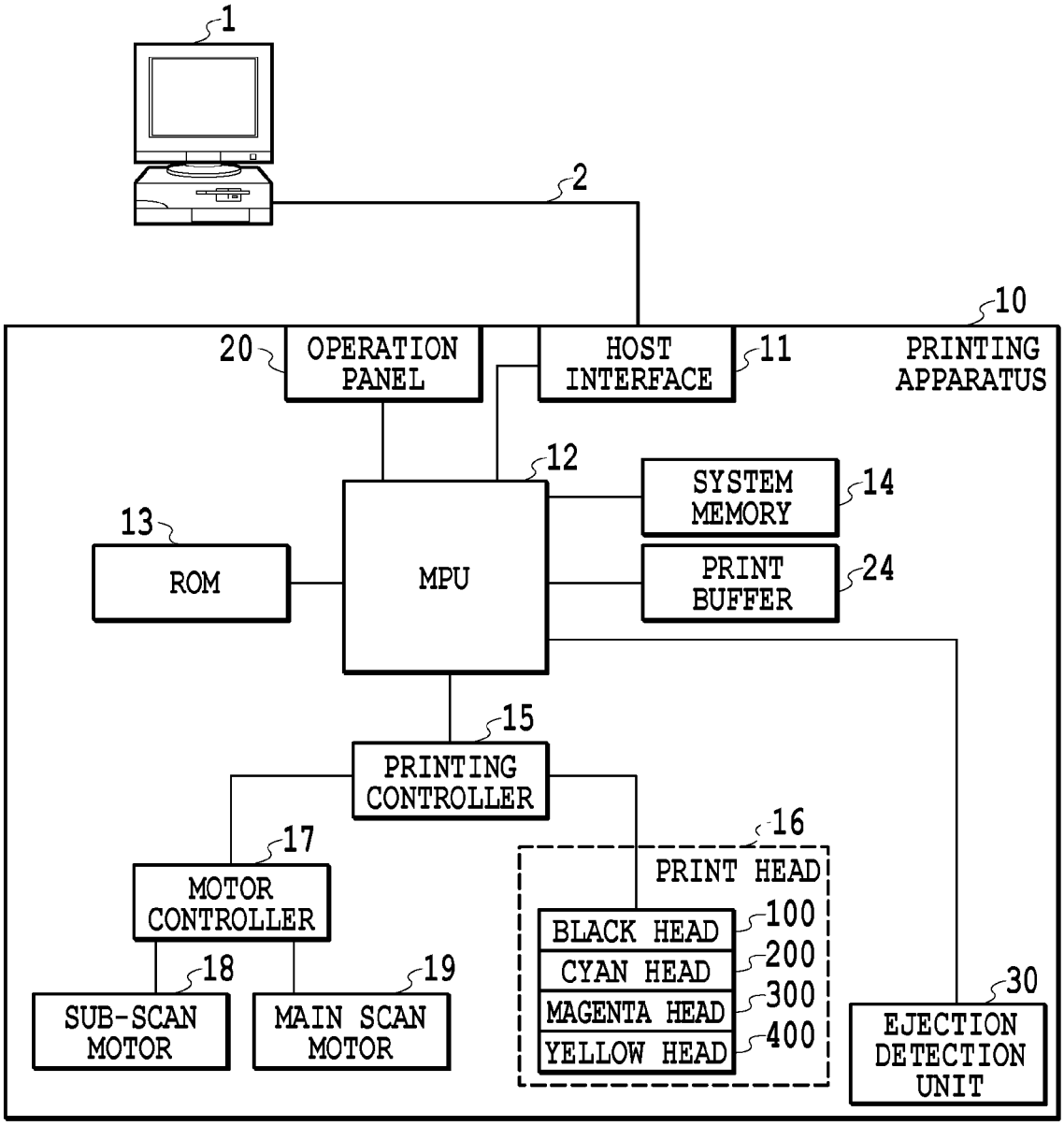
FIG. 2 is a block diagram illustrating the arrangement of a control system for the printing apparatus according to the first embodiment.
Figure 5A:
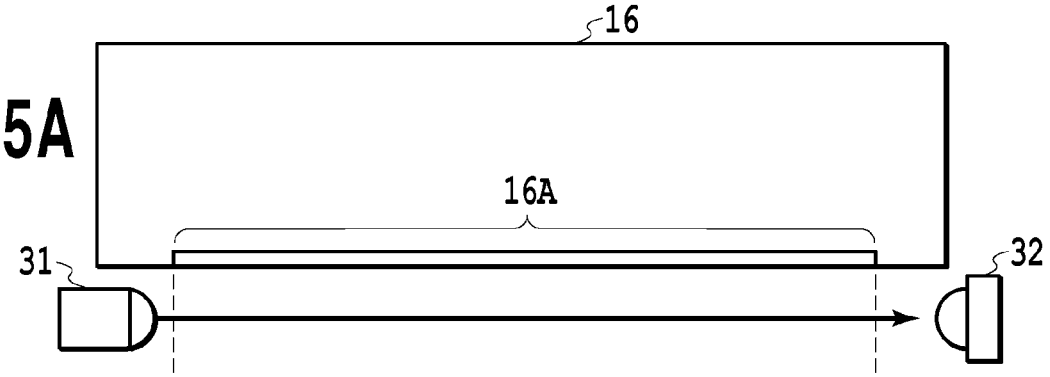
FIGS. 5A, 5B, and 5C are schematic diagrams showing a relationship between the locations of nozzles and changes in the quantities of received photocurrents, and a relationship between the locations of nozzles and an LED drive current according to the first embodiment.
Figure 5B:
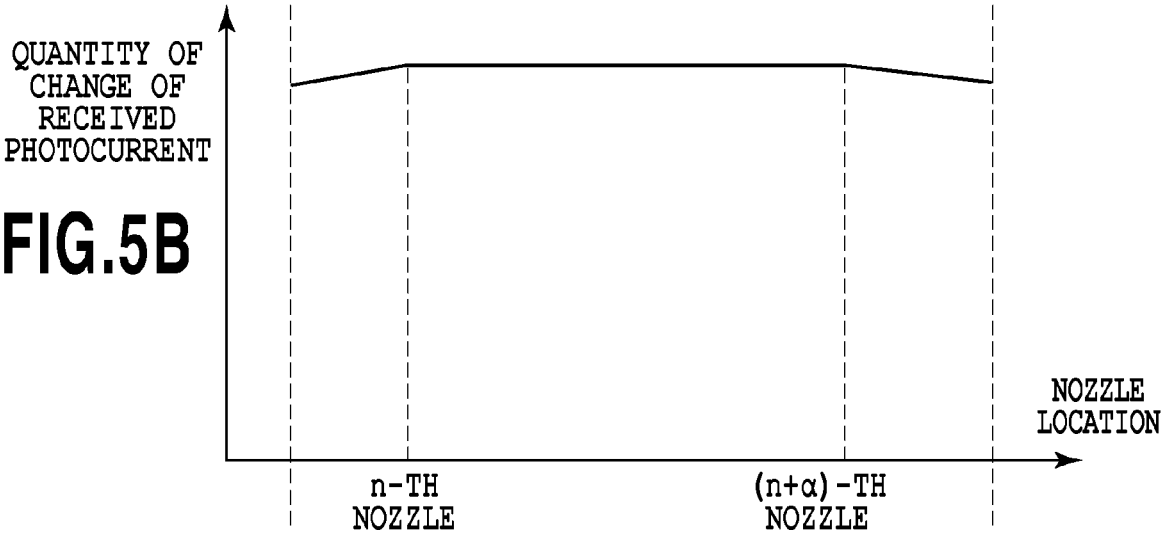
Figure 5C:
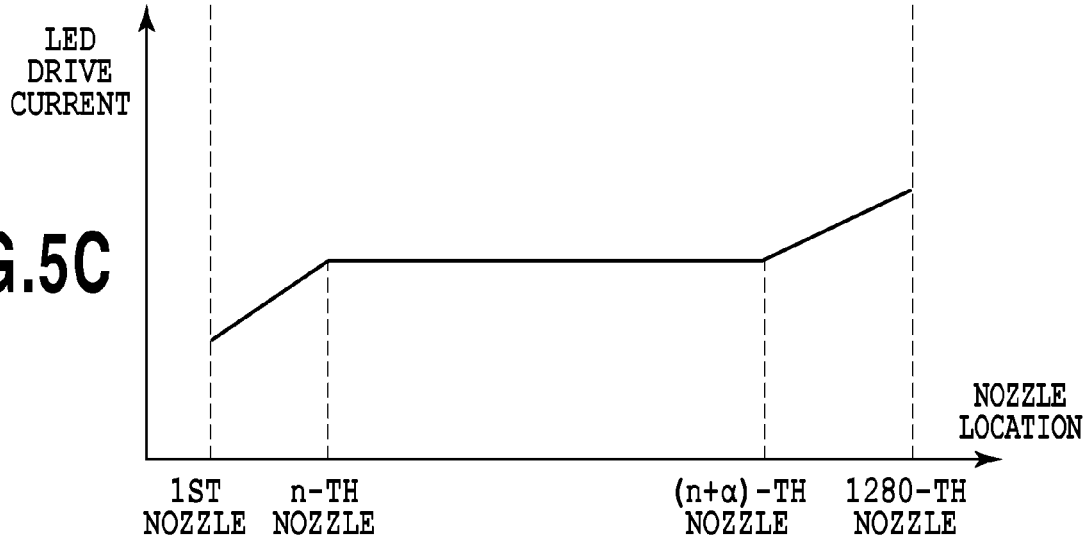

The print head 16 includes a plurality of ink jet heads in consonance with the number of ink colors as liquids to be ejected. For example, as shown in FIG. 2, four ink jet heads 100, 200, 300 and 400 are arranged for black (K), cyan (C), magenta (M) and yellow (Y) inks. The individual ink jet heads include a nozzle array wherein a plurality of nozzles are aligned in the sub-scan direction (Y direction). In this embodiment, as shown in FIGS. 5A, 5B, and 5C, for each ink jet head, an nozzle array 16A are prepared by aligning the nozzles in the sub-scan direction, beginning from the first nozzle to the 1280-th nozzle. Furthermore, in this embodiment, an ejection failure detection unit 30 is provided in an end of a scan region scanned by the print head 16 to examine the nozzle arrays prepared for the individual ink jet heads, and detect an ejection-defective nozzle from which ink droplets cannot be appropriately ejected.

FIG. 2 is a block diagram showing the arrangement of the control system of the printing apparatus 10 according to the first embodiment. In FIG. 2, the host computer 1 is employed to create print data by using a drawing application that has been installed, and to transmit the print data to the printing apparatus 10. A host interface 11 receives the print data from the host computer 1, and temporarily stores the print data in a print buffer 24 via an MPU (microprocessor) 12 that controls the whole printing apparatus 10. A startup program and a compressed control program are stored in a ROM 13, and at a startup time, the control program is loaded into a system memory 14 and decompressed.

An operation panel 20 includes a display device for displaying an operation instruction issued to the main body of the printing apparatus 10 and the current state of the main body. A sub-scan motor 18 drives a conveying roller (not shown) that conveys the printing medium P. A main scan motor 19 drives and reciprocates a belt (not shown) where the print head 16 is fixed in position. A printing controller 15 controls a motor controller 17, which controls the sub-scan motor 18 and the main scan motor 19, and also controls the print head 16 for ejection of ink. The print head 16 of this embodiment includes four color ink jet heads, i.e., the black head 100, the cyan head 200, the magenta head 300 and the yellow head 400. It should be noted, however, that the print head 16 may also include an ink jet head that ejects another color ink, or may include only one ink jet head. Furthermore, in the present invention, not only ink that is a liquid that contains a coloring material, but also an image quality enhancement liquid ejected from nozzle, which improves the image quality may be included in the print head 16. In this embodiment, the above described liquid, including the image quality enhancement liquid, is called ink.

The process for detecting the conditions of nozzles employed for the embodiment will be described in detail by employing the drawings.

Figure 3A:
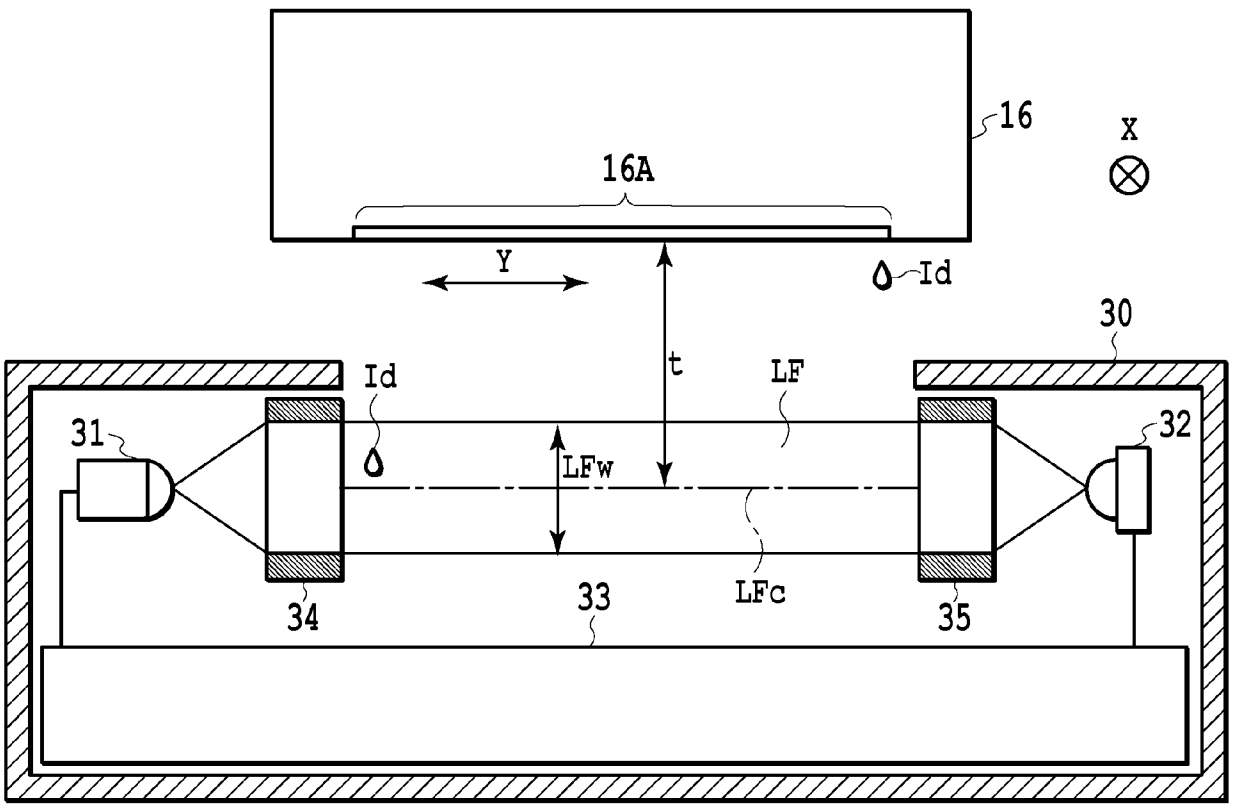
FIGS. 3A and 3B are schematic diagrams of the arrangement of an ejection detection device according to the first embodiment.
Figure 3B:
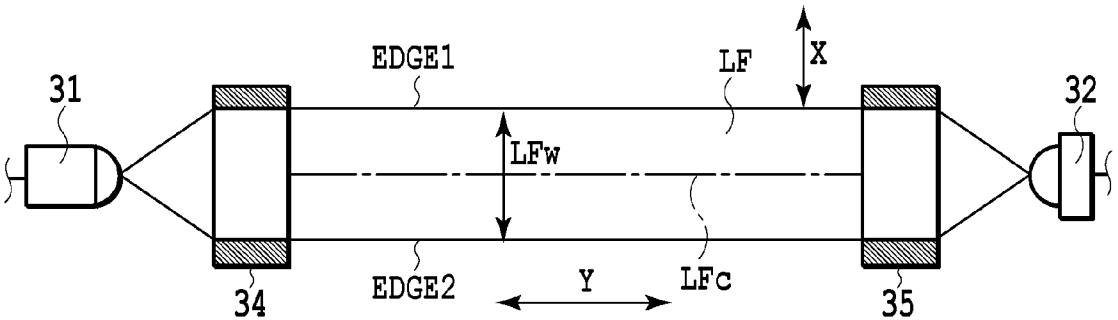

FIGS. 3A and 3B is a schematic diagram illustrating the print head 16 and the ejection detection unit 30 according to this embodiment. FIG. 3A is a schematic longitudinal sectional side view and FIG. 3B is a schematic plan view. When an ink droplet Id is expelled by the print head 16 into flight, and passes the luminous flux extended from a light-emitting device (LED) 31 to a photodiode (PD) 32 that serves as a light-receiving device, the quantity of received light is slightly changed due to the interception of light by the ink droplet. The detection of this small change is the basic principle of the ejection detection device. In this embodiment, a single LED 31 serves as a light-emitting unit for the present invention, and the photodiode 32 serves as a light-receiving unit for the present invention. Further, the LED 31 and the PD 32 are controlled by a control circuit 33 connected to the MPU 12.

In the ejection detection unit 30, light emitted by the LED 31 is converged through an LED slit 34, and is received through a PD slit 35 by the PD 32 to avoid the affect of ambient light and the attachment of a mist. As shown in FIG. 3A, nozzle arrays 16A of the print head 16 are arranged so as to fall within the range of luminous flux LF from the LED 31 to the PD 32 in the nozzle array direction (Y direction). When a luminous flux center LFc is defined as an optical axis, the individual nozzle arrays 16A and the optical axis LFc are parallel to each other, and a distance t between them is 2 mm to 4 mm. Incidentally, in FIG. 3B, LFw represents the width of the luminous flux LF in a main scan direction (X direction) perpendicular to a nozzle arrangement direction (Y direction).

Figure 4:
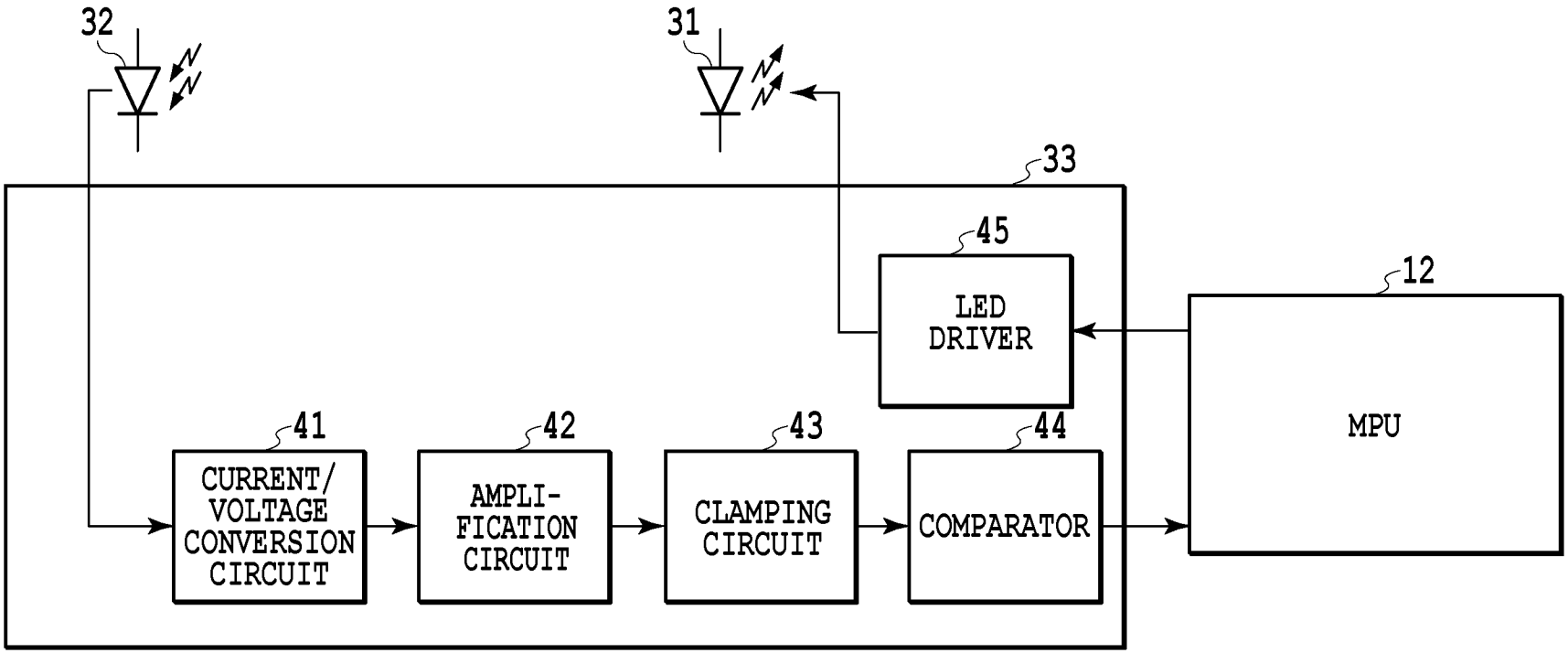
FIG. 4 is a block diagram showing the internal arrangement of a control circuit for the ejection detection device in FIG. 3.

FIG. 4 is a block diagram showing the internal structure of the control circuit 33 of an ejection detection device 30 according to this embodiment. A current/voltage conversion circuit 41 converts, into a voltage signal, a value of a current that flows across the photodiode (PD) 32, and outputs the voltage signal. An amplification circuit 42 amplifies the voltage signal output by the current/voltage conversion circuit 41. A clamping circuit 43 employs a control signal issued in synchronization with ejection of an ink droplet, and maintains a predetermined value for the level of a signal that is output by the amplification circuit 42 immediately before the ejection of the ink droplet is observed. After an ink droplet has been ejected and immediately before the ink droplet begins to intercept the light flux LF during a flight, the clamping operation is released. As a result, even when low-frequency ambient light, for example, has entered, the adverse affect can be removed by the clamping circuit 43, and a detection signal can be evaluated based on a fixed reference voltage.

A comparator 44 compares the voltage output by the clamping circuit 43 with a reference voltage, performs binarization processing for the comparison results, and outputs the obtained results to the MPU 12. The MPU 12 employs the binarized comparison results to determine a period during which a reduction of the light quantity (a change in the light quantity) that occurred due to the interception of a part of the luminous flux by the ink droplet ejected from the nozzle is a predetermined level or higher.

Figure 14:
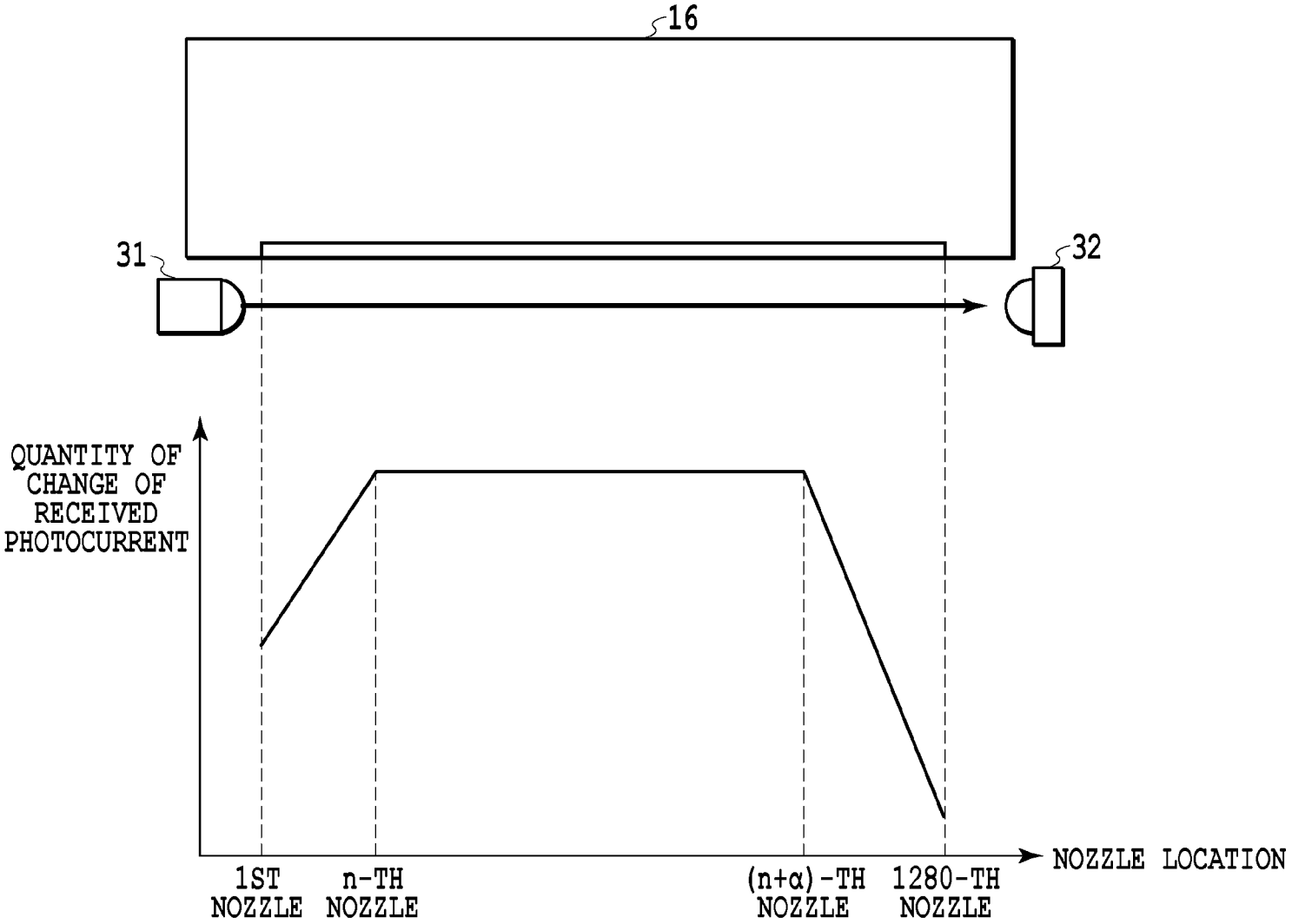
FIG. 14 is a schematic diagram showing a relationship between the locations of nozzles of a conventional ejection detection device and changes in the quantities of received photocurrents.

An LED driver 45 is an LED driver that drives the LED 31. In a case wherein the drive current value of the LED 31 is fixed by the LED driver 45 in order to obtain an appropriate detection output of the PD 32 with respect to the distance between the LED 31 and the PD 32, a phenomenon shown in FIG. 14 appears in the detection characteristics of the PD 32. Specifically, when detection is performed for ink droplets ejected from the nozzles that belong to the nozzle array 16A to be detected and that are located near the LED 31, a part of light that is not intercepted by the ink droplets because of a diffraction phenomenon has reached the light-receiving face of the PD 32. A part of light reflected by the print head 16 has also reached the light-receiving face of the PD 32. Furthermore, light emitted by the LED 31 varies depending on the spatial energy distribution characteristics, but generally is diverging light, and since the surface energy density of light is reduced as the light approaches the PD 32, the quantity of detection light required for detection of ink droplets ejected by the nozzles located a distance from the LED 31 (near the PD 32) is deteriorated.

Therefore, in this embodiment, as shown in FIG. 5C, the LED drive current output by the LED driver 45 is controlled, so that the LED drive current is changed in accordance with the locations of the nozzles. For example, the LED drive current is increased for the first to the n-th nozzles closest to the LED 31 to gradually raise the light emission intensity of the LED 31 from a low level. Detection light rays emitted by the LED 31 are diverging light rays, and the rays intercepted by ink droplets ejected by nozzles close to the LED 31 are easily affected by optical diffraction. The change of the received light quantity that occurs depending on whether ink droplets were ejected tends to be reduced when the nozzles are located near the LED 31. Accordingly, in the present embodiment, as a nozzle is closer to the LED 31, the emission intensity of the LED is smaller, and a reduction of a change in the quantity of received light caused by optical diffraction is made small. Further, for the n-th to the (n+$\alpha$)-th nozzles of the nozzle array 16A, the LED drive current is maintained at a constant level, and for the (n+$\alpha$)-th nozzle to the 1280-th nozzle that is farthest from the LED 31, the emission intensity is gradually increased again. This control for gradually increasing the emission intensity for the (n+$\alpha$)-th to the 1280-th nozzles is performed to compensate for attenuation of light which is emitted by the LED 31 and which attenuates as it approaches the PD. As a result, as shown in FIG. 5B, the amount of a change in the received photocurrent generated when ink is normally ejected can be kept substantially constant, and without need to control the number of ejected liquid droplets or the diameter of ejected liquid droplets in accordance with the locations of the nozzles, detection of an ejection failure can be performed by employing an inexpensive circuit structure. Different rates of changing the LED drive current are employed between the detection area that includes the first to the n-th nozzles and the detection area that includes the (n+α) to the 1280-th nozzles. This is because the optical characteristics of the LED 31 that emits light, the reflectivity of a member around the head that reflects light, the sensitivity characteristics of the PD32 that receives light, and the like are adjusted to set a rate of changing emission intensity to vary depending on the location of the detection target nozzle. The control of the emission intensity of the LED 31 is performed by the MPU 12 controlling the LED driver 45 provided in the control circuit 33.

The ejection failure detection processing performed by the MPU 12 for this embodiment will now be described by employing the flowchart in FIG. 6.

First, at S101 the MPU 12 drives the LED driver 45 to turn on the LED 31 of the ejection detection unit 30. At S102, the optical axes of the ejection detection device 30 and the nozzle array 16A of the print head 16 are aligned. This operation will be described in detail later, while referring to FIG. 7. Since the nozzles that have not been used for a period of time for ejection may be clogged with viscous ink, preliminary ejection is performed at S103 to remove clogging of the nozzles before the ejection failure detection is performed. This process is performed by the MPU 12 driving the print head 16 via the printing controller 15.

At S104, the MPU 12 permits the printing controller 15 to apply the LED driving current to a detection target nozzle in accordance with a location of the detection target nozzle and to eject ink from the target nozzle (S105). Then, at S106, whether ink droplets are detected by the PD 32 of the ejection detection device 30 is determined based on the determination whether the detected voltage for the PD 32 is higher than a predetermined threshold value. This determination is performed by the MPU 12 based on a signal output by the comparator 44 provided in the ejection detection device 30. When it is ascertained that ink droplets are detected, program control advances to S106, or when it is ascertained that ink droplets are not detected, program control moves to S107.

When it is ascertained at S106 that an amount of change of the detected voltage is higher than the predetermined threshold value, and therefore, ink droplets have been normally ejected, at S107 data that represents that the detection target nozzle is a normal nozzle is written at the address corresponding to the nozzle number in a memory having the capacity for all of the nozzles. When it is ascertained at S106 that the detected voltage is equal to or lower than the predetermined threshold value, and that ink droplets have not been normally ejected, at S108 data that represents the detection target nozzle is an ejection-defective nozzle is written to the address of the memory that corresponds to the nozzle number.

At S109, the MPU 12 permits the control circuit 33 to set the LED drive current in accordance with the location of a nozzle employed for ejection, following the nozzle used at S105. Thereafter, at S110, a check is performed to determine whether the ejection failure detection has been performed for all of the nozzles. In a case wherein the failure detection has been completed for all of the nozzles, program control advances to S111, and the LED 31 of the ejection detection unit 30 is turned off. In a case wherein the ejection failure detection is not yet completed for all of the nozzles, program control returned to S104 after changing a detection target nozzle at S112, and the processes at S106 to S110 are repeated.

Figure 6:
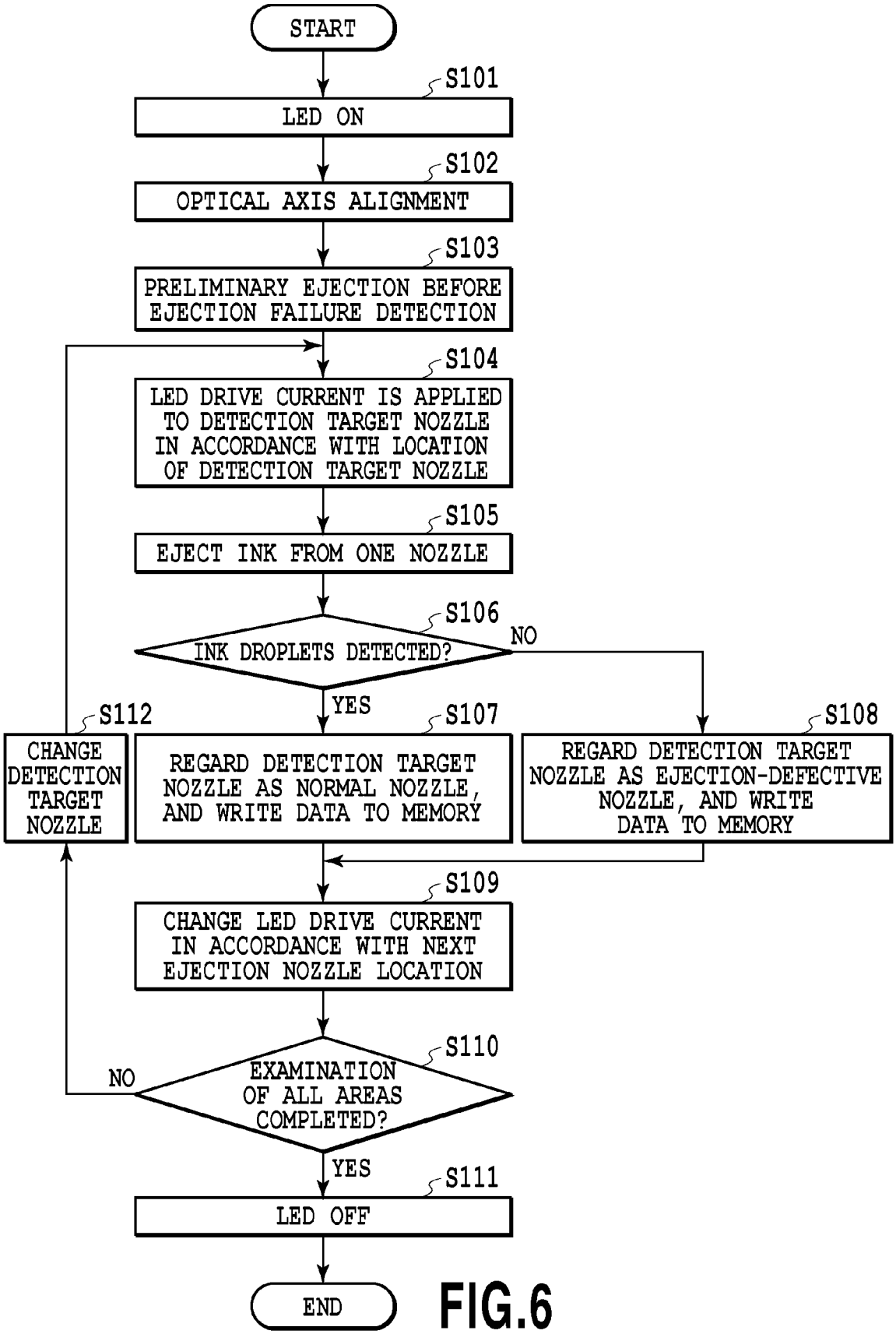
FIG. 6 is a flowchart showing the ejection failure detection operation performed for the first embodiment.

When the processing in the flowchart in FIG. 6 is performed, the locations of the ejection-defective nozzles and the locations of the normal nozzles, from which normal ejection of ink is enabled, are written to the memory. Therefore, the ejection-defective nozzles and the normal nozzles in the nozzle arrays 16A can be identified by referring to the memory.

Figure 7:
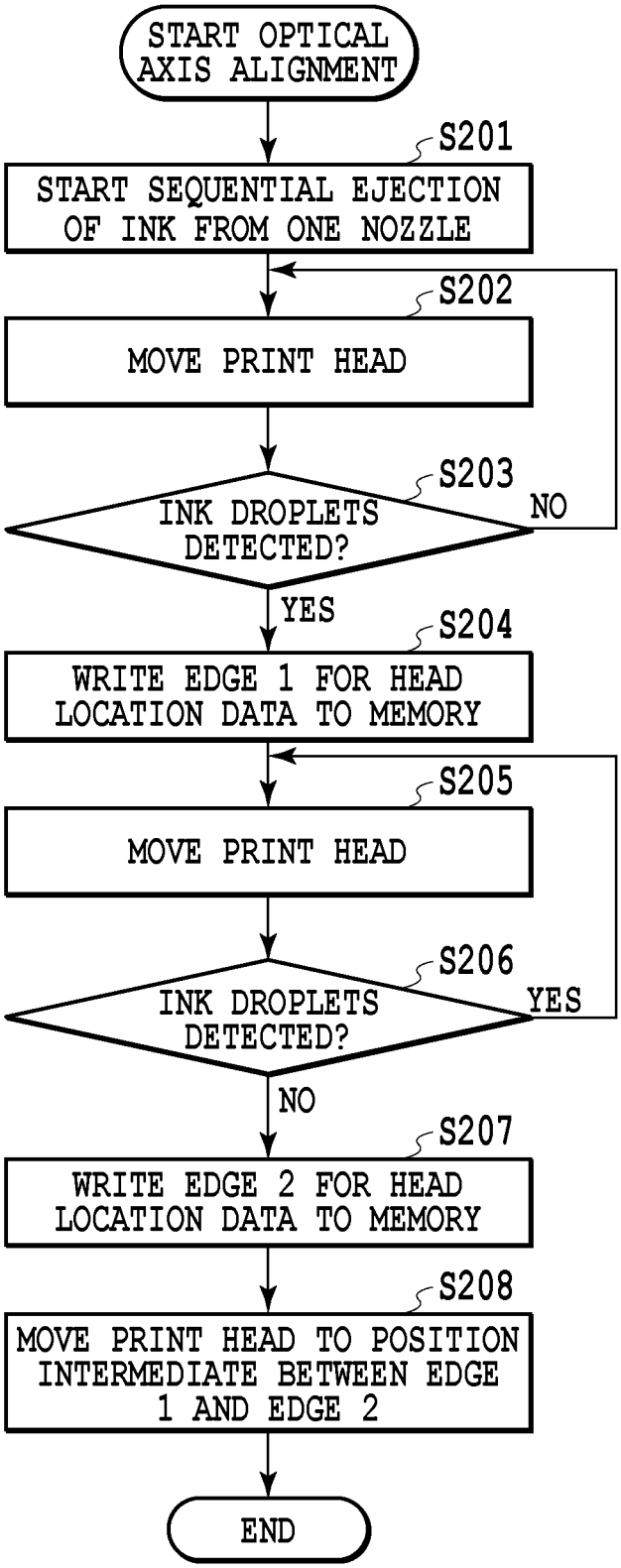
FIG. 7 is a flowchart showing the optical axis alignment operation performed for the first embodiment.

The processing performed at S102 in FIG. 6 for the optical axis alignment will now be described in detail while referring to the flowchart in FIG. 7.

At S201, ejection of ink is repeated for a specific nozzle at a predetermined cycle. Then, at S202, in the state wherein the ejection failure detection unit 30 is held at a fixed position, the print head 16 is moved from a predetermined home position in the main scan direction (X direction), relative to the optical axis LFc of the ejection detection device 30. The main scan direction is a direction perpendicular to the optical axis LFc of the ejection failure detection unit 30, and is a direction perpendicular to the plane of paper in FIG. 3A. Thereafter, at S203, a check is performed to determine whether ink droplets are detected during the movement of the print head 16. In this process, whether ink droplets are detected is determined, in the same manner as described above, based on whether the detected voltage of the PD 32 of the ejection detection device 30 is higher than the predetermined threshold value. When ink droplets are detected, program control advances to S204, or when ink droplets are not detected, program control returns to S202 to move the print head 16 in the main scan direction.

When it is ascertained at S203 that ink droplets are detected, at S204 the current location of the print head 16 is regarded as an edge 1 shown in FIG. 3B, and is written to the memory in order to store the location of the print head 16. Then, at S205, the print head 16 is moved further in the main scan direction. At S206, a check is performed to determine while ink droplets are detected during the movement of the print head 16. In a case wherein ink droplets are not any longer detected, program control advances to step S207, and the location of the print head 16 obtained when ink droplets are not any longer detected is regarded as an edge 2 shown in FIG. 3B, and is written to the memory to store the location of the print head 16. Further, in a case wherein the ink droplets are still detected at S206, program control returns to S205, and the print head 16 is moved further in the main scan direction. The position intermediate between the edge 1 and the edge 2 detected at S204 and S207 corresponds to the optical axis LFc that serves as the center position of the luminous flux LF. Therefore, at S208 the MPU 12 obtains the position intermediate between the edge 1 and the edge 2, and moves the print head 16 to the intermediate position. Thereafter, the alignment of the optical axis of the ejection detection device 30 with the nozzle array 16A of the print head 16 (optical-axis alignment) is terminated.

In the description for this embodiment, the detection for an ejection failure has been performed for a single print head 16; however, it is apparent that the ejection failure detection can be performed in the same manner for a plurality of heads mounted to a liquid ejection apparatus. That is, when the operation shown in FIG. 7 is sequentially performed for the nozzle arrays of the individual print heads, an ejection failure can be detected for all of the nozzle arrays.

Further, the ejection failure detection for a nozzle array need not always be performed beginning from the first nozzle of the nozzle array (the nozzle nearest the LED 31), and so long as the relationship between the drive current value of the LED 31 and the ink ejection location is established, an arbitrary nozzle may be employed to begin the ejection failure detection.

As described above, according to the first embodiment, a complicated and difficult control process for changing the number of ejected liquid droplets or the diameter of ejected liquid droplets in accordance with the locations of the individual nozzles of the print head 16 is not required, and an inexpensive structure that adjusts the quantity of light of the LED 31 need only be employed to accurately detect the conditions of the nozzles, such as an ejection failure.

Second Embodiment

A second embodiment of the present invention will now be described.

Figure 8A:
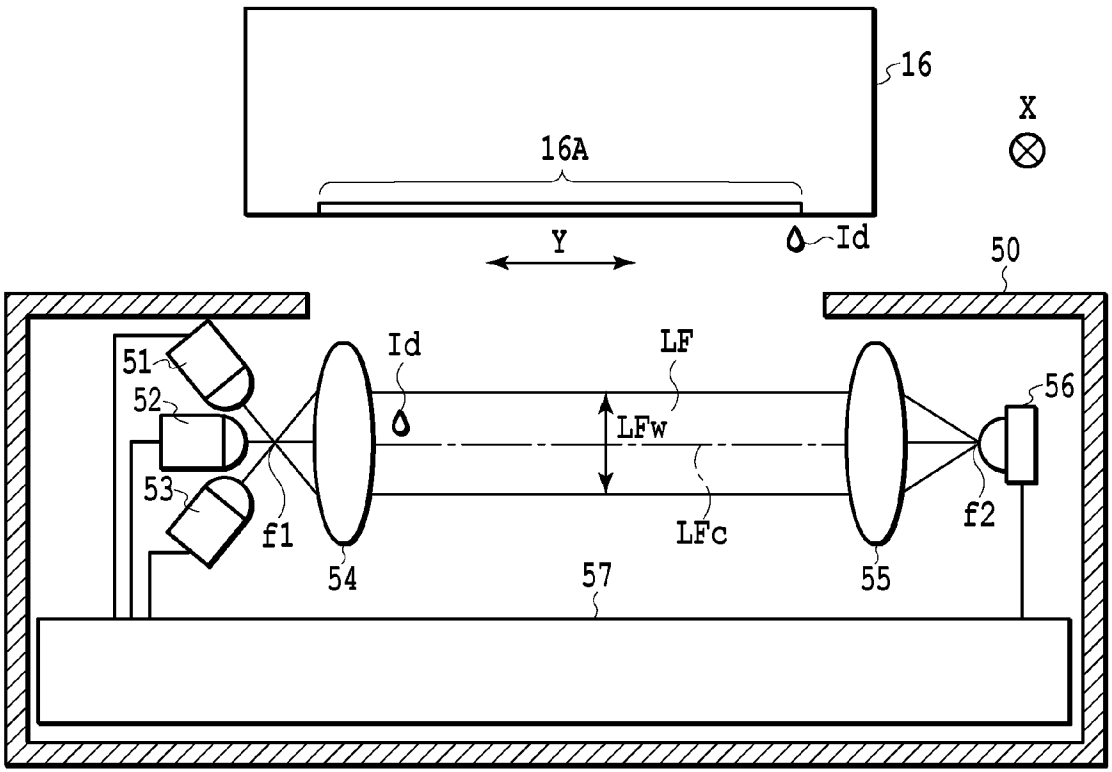
FIGS. 8A and 8B are schematic diagrams of the arrangement of an ejection detection device according to a second embodiment of the present invention.
Figure 8B:
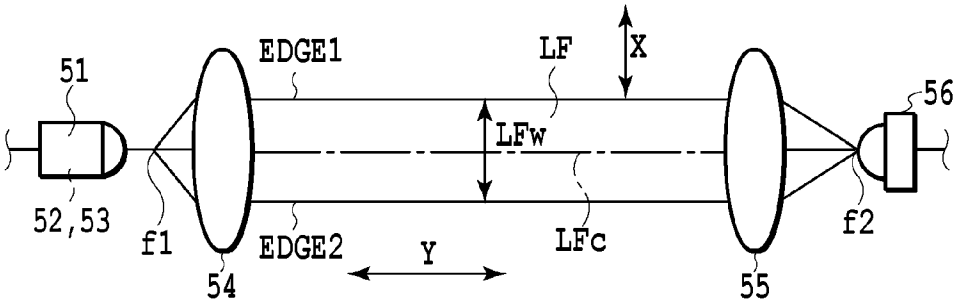

For the first embodiment, a single LED has been employed to adjust the quantity of light. In the second embodiment, a plurality of inexpensive LEDs that emit only a small amount of light are employed to adjust the quantity of light. FIGS. 8A and 8B are schematic diagrams illustrating a print head 16 and an ejection detection device 50 according to the second embodiment. FIG. 8A is a schematic longitudinal sectional side view and FIG. 8B is a schematic plan view. In the second embodiment as well as in the first embodiment, when an ink droplet Id ejected by the print head 16 passes a light flux extended from the light-emitting devices (LEDs 51 to 53) to a light-receiving device (PD 56), the quantity of received light is slightly changed due to the interception of the light, and the detection of this small change is the basic principle for the ejection failure detection.

For the ejection detection device 50, a characteristic such that the rays of light that have passed through a focal point f1 of a convex lens (optical system) 54 become parallel to an optical axis LFc is employed, and the light beams emitted by the three LEDs 51 to 53 become parallel to each other to enter a convex lens 55 on the PD side. The light beams that have passed through the convex lens 55 on the PD side are received by a PD 56 located at a local point f2. The nozzle arrays of the print head 16 are arranged so as to fall, in the nozzle array direction (Y direction), in the range of the luminous flux that is converged by the convex lens 54 on the LED side, and is extended to the convex lens 55 on the PD side.

Figure 9:
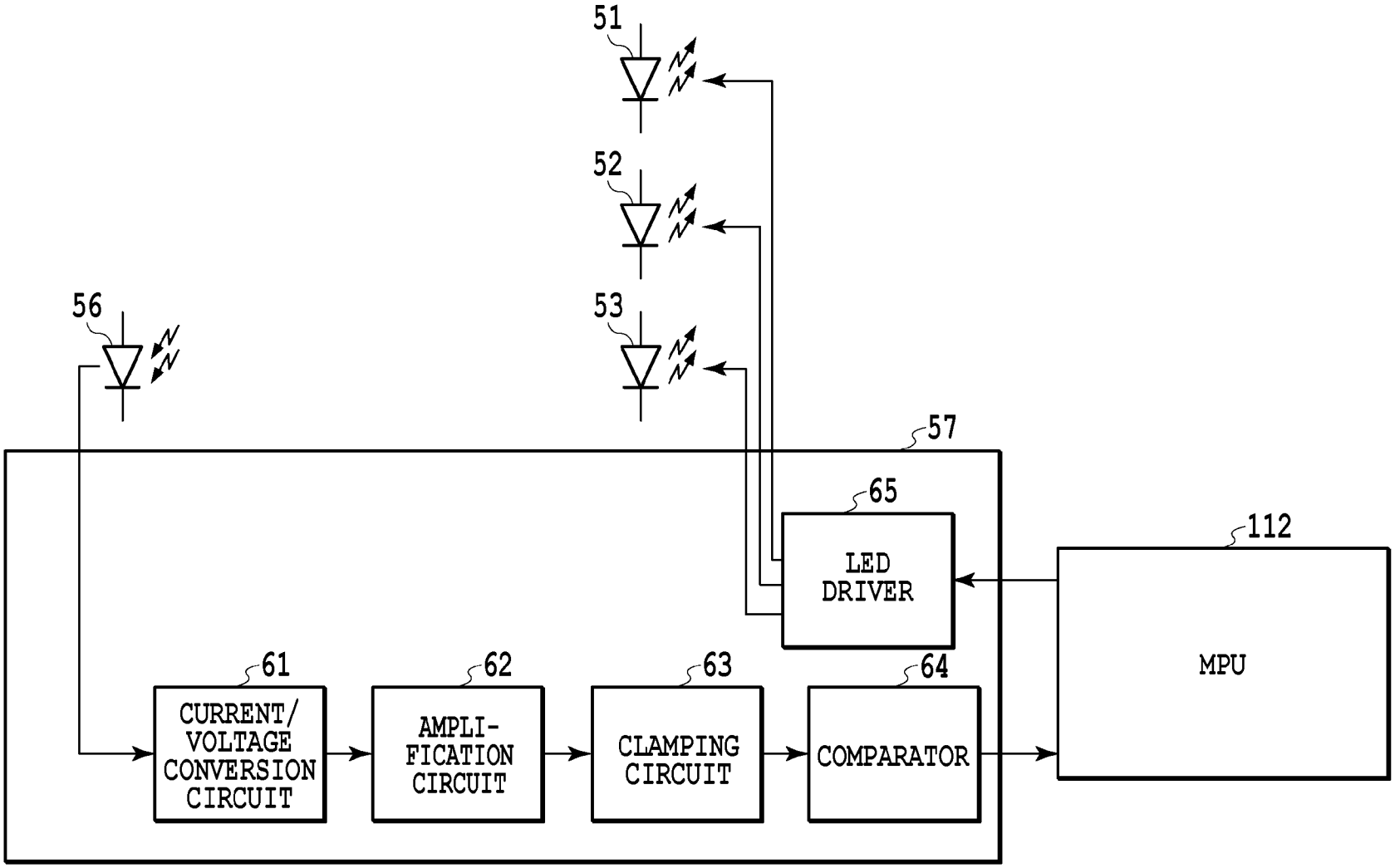
FIG. 9 is a block diagram showing the internal arrangement of the control circuit of the ejection detection device in FIG. 8A.

FIG. 9 is a block diagram illustrating the internal structure of a control circuit 57 according to the second embodiment of the present invention. The control circuit 57 in FIG. 9 includes a current/voltage conversion circuit 61, an amplification circuit 62, a clamping circuit 63, a comparator 64 and an LED driver 65. For the control circuit 57, the current/voltage conversion circuit 61, the amplification circuit 62, the clamping circuit 63 and the comparator 64 are the same as the current/voltage conversion circuit 41, the amplification circuit 42, the clamping circuit 43 and the comparator 44 in the first embodiment. Therefore, no further explanation of these components will be given. A difference from the first embodiment is that the control circuit 57 of the second embodiment includes the LED driver 65 that can drive the three LEDs 51 to 53 at the same time.

A method for driving the LEDs 51 to 53 will now be described by employing FIG. 10. In the second embodiment, for a first drive area extended from the first nozzle to the n-th nozzle, only the LED 51 is driven to increase the LED drive current and to gradually increase the emission intensity from a low level. For a second drive area extended from the n-th nozzle to the (n+α)-th nozzle, both the LED 51 and the LED 52 are driven to maintain the constant level for the individual LED drive currents and for the emission intensity. Furthermore, for a third drive area extended from the (n+α)-th nozzle to the 1280-th nozzle, all the three LEDs 51, 52 and 53 are driven to increase the individual LED drive currents in accordance with the locations of the nozzles and to gradually raise the emission intensity. As a result, substantially a constant level for the received photocurrent can be maintained, and without a large detection range being required, appropriate detection for an ejection failure can be stably performed by employing an inexpensive structure.

The ejection failure detection processing performed by an MPU 112 for the second embodiment will now be described while referring to the flowcharts in FIGS. 11A and 11B.

First, at S301 the MPU 112 drives the LED driver 65 to turn on the LED 51 of the ejection failure detection unit 50. At S302, the optical axis alignment is performed for the LED 51 and the PD 56. Since the optical axis alignment process is the same as that in FIG. 7 explained for the first embodiment, no further explanation for this process will be given. At S303, preliminary ejection is performed to remove clogging of nozzles before detection for an ejection failure is performed.

Figure 10:
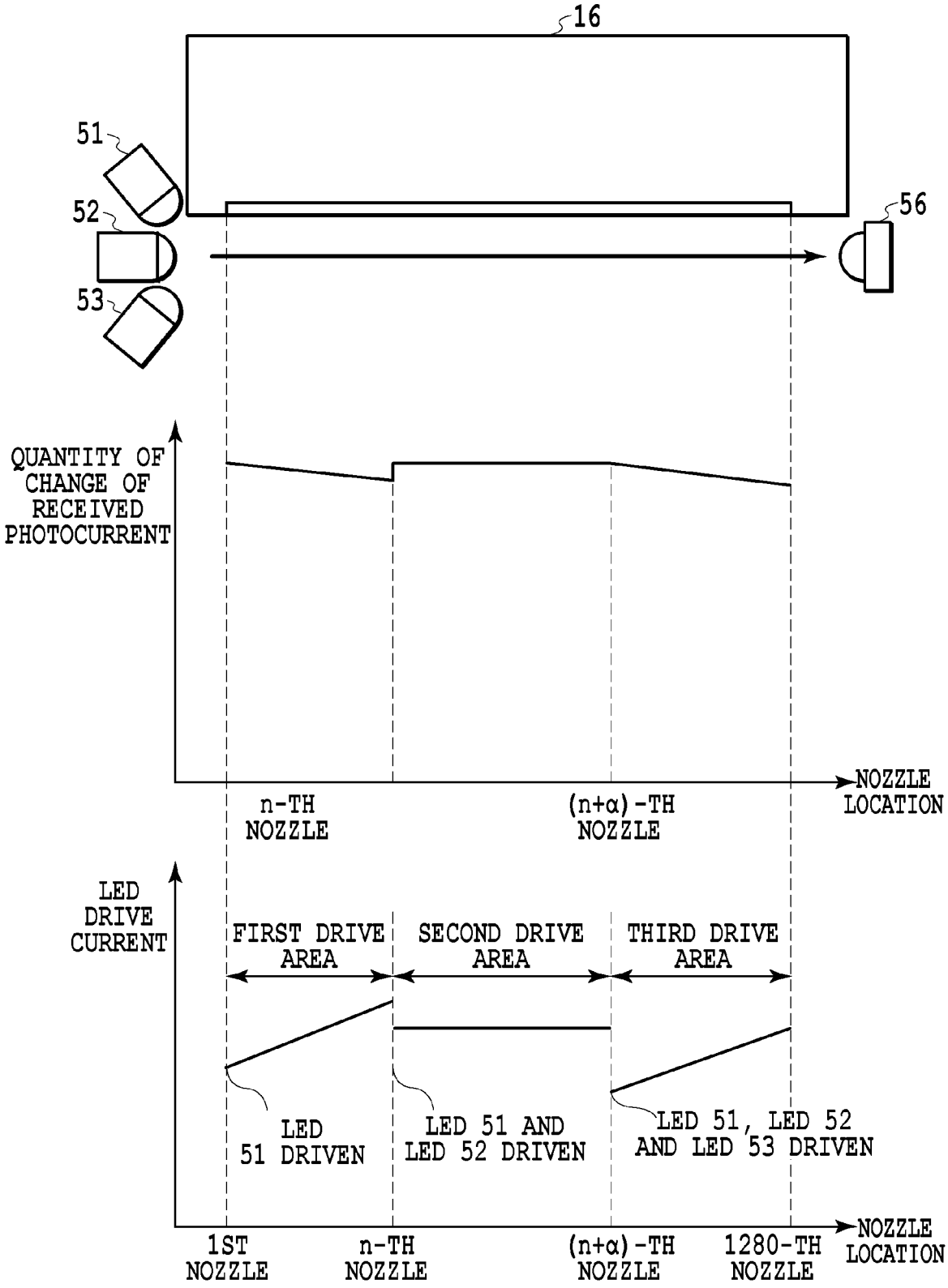
FIG. 10 is a schematic diagram showing a relationship between locations of nozzles and changes in the quantities of received photocurrents, and a relationship between locations of nozzles and an LED drive current according to the second embodiment.

At S304, an LED drive current is applied in accordance with a location of the nozzles (detection target nozzles) that belong to the first drive area in FIG. 10 that is a target area for ejection failure detection (S304) and ink is ejected from one detection target nozzle (S305). Then, at S306, whether ink droplets are detected is determined based on the determination whether the detected voltage for the PD 56 is higher than a predetermined threshold value of the ejection detection device 50. When it is ascertained that ink droplets are detected, program control advances to S307, or when it is ascertained that ink droplets are not detected, program control moves to S308.

When it is ascertained that ink droplets have been normally ejected, at S307 data that represents that the detection target nozzle is a normal nozzle is written at the address corresponding to the nozzle number in a memory having the capacity for all of the nozzles. When it is ascertained that ink droplets are not normally ejected, at S308 data that represents the detection target nozzle is an ejection-defective nozzle is written to the memory having a capacity for all of the nozzles, at the address that corresponds to the nozzle number.

At S309, a check is performed to determine whether a nozzle employed for ejection of ink, following the nozzle used at S304, is located within the second drive area shown in FIG. 10, and when it is ascertained that the nozzle employed next is included in the second drive area, program control advances to S309, or when it is ascertained that the nozzle does not belong to the second drive area, program control moves to S311. At S309, the MPU 112 turns on the LED 52 of the ejection detection device 50, while maintaining the LED 51 on. For driving the LEDs 51 and 52 at this time, at S311 an LED drive current is designated in accordance with the location of the nozzle that is employed following the nozzle used at S305 for ejection of ink. Thereafter, at S312, a check is performed by MPU 112 to determine whether the nozzle employed for ejection of ink, following the nozzle used at S305, is located within the third drive area, and when the nozzle employed next belongs to the third drive area, program control advances to S313, or when the nozzle does not belong to the third drive area, program control moves to S317.

At S313, the MPU 112 turns on the LED 52 and the LED 53 of the ejection detection unit 50, while maintaining the LED 51 on. At this time, at S314 the LED drive current is designated for each of the LED 51, the LED 52 and the LED 53 in accordance with the location of the nozzle employed for ejection of ink, following the nozzle used at S305. Thereafter, at S315 a check is performed to determine whether the ejection failure detection has been performed for all of the nozzles. When the ejection failure detection has been completed for all of the nozzles, program control advances to S316, and the LED 51, the LED 52 and the LED 53 of the ejection detection device 50 are turned off. When the ejection failure detection for all the nozzles is not yet completed, program control returns to S304 after the detection target nozzle is changed at S318, and the processing beginning at S304 is repeated. Further, when it is ascertained at S312 that the location the next nozzle does not belong to the third drive area, program control moves to S317, and the LED 52 and the LED 53 of the ejection detection device 50 are turned off.

Figure 11B:
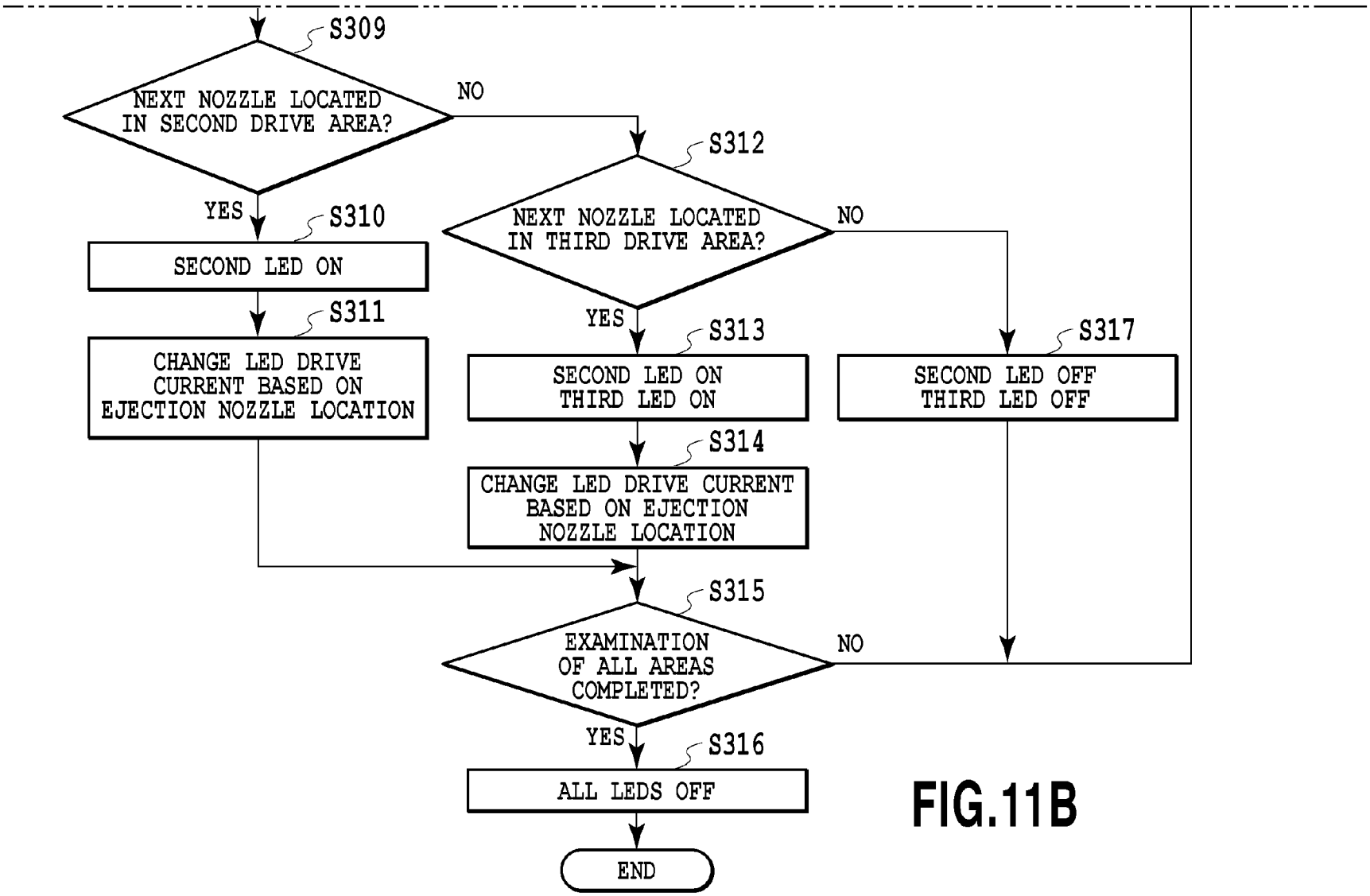
FIG. 11B is a flowchart showing the ejection failure detection of the other part of operations performed for the second embodiment.

When the processing in the flowcharts in FIGS. 11A and 11B are performed in this manner, the MPU 112 writes, to the memory, the locations of the ejection-defective nozzles and the locations of the normal nozzles, from which normal ejection of ink is enabled. Therefore, the ejection-defective nozzles and the normal nozzles in the nozzle arrays 16A can be identified by referring to the memory. Further, in the second embodiment, since three inexpensive LEDs 51, 52 and 53 that emit only a small amount of light are employed to adjust the quantity of light, and since the structure required for driving LED 51, LED 52, and LED 53 are substantially the same as the structure required for driving a single LED, the cost for the driving circuits will not be increased.

Further, the ejection failure detection for a nozzle array need not always be performed beginning from the first nozzle of the nozzle array (the nozzle nearest the LEDs 51, 52 and 53), and so long as the relationship between the drive current values of the LEDs 51 to 53 and the ink ejection location is established, an arbitrary nozzle may be employed to begin the ejection failure detection.

In the first and second embodiments, a serial type printing apparatus has been employed as an example; however, the present invention can also be applied for a printing apparatus of so-called full-line printing type that performs printing by employing a print head fixed in a position, while continuously conveying a printing medium. The printing apparatus of full-line printing type generally employs an elongated print head, wherein nozzles are arranged over a width greater than the width of a printing medium to be employed. Therefore, in this case, when a plurality of light-emitting devices are employed to form light flux between these light-emitting devices and a light-receiving device in the same manner as in the second embodiment, the elongated print head can be easily coped with to perform appropriate ejection failure detection.

Figure 12:
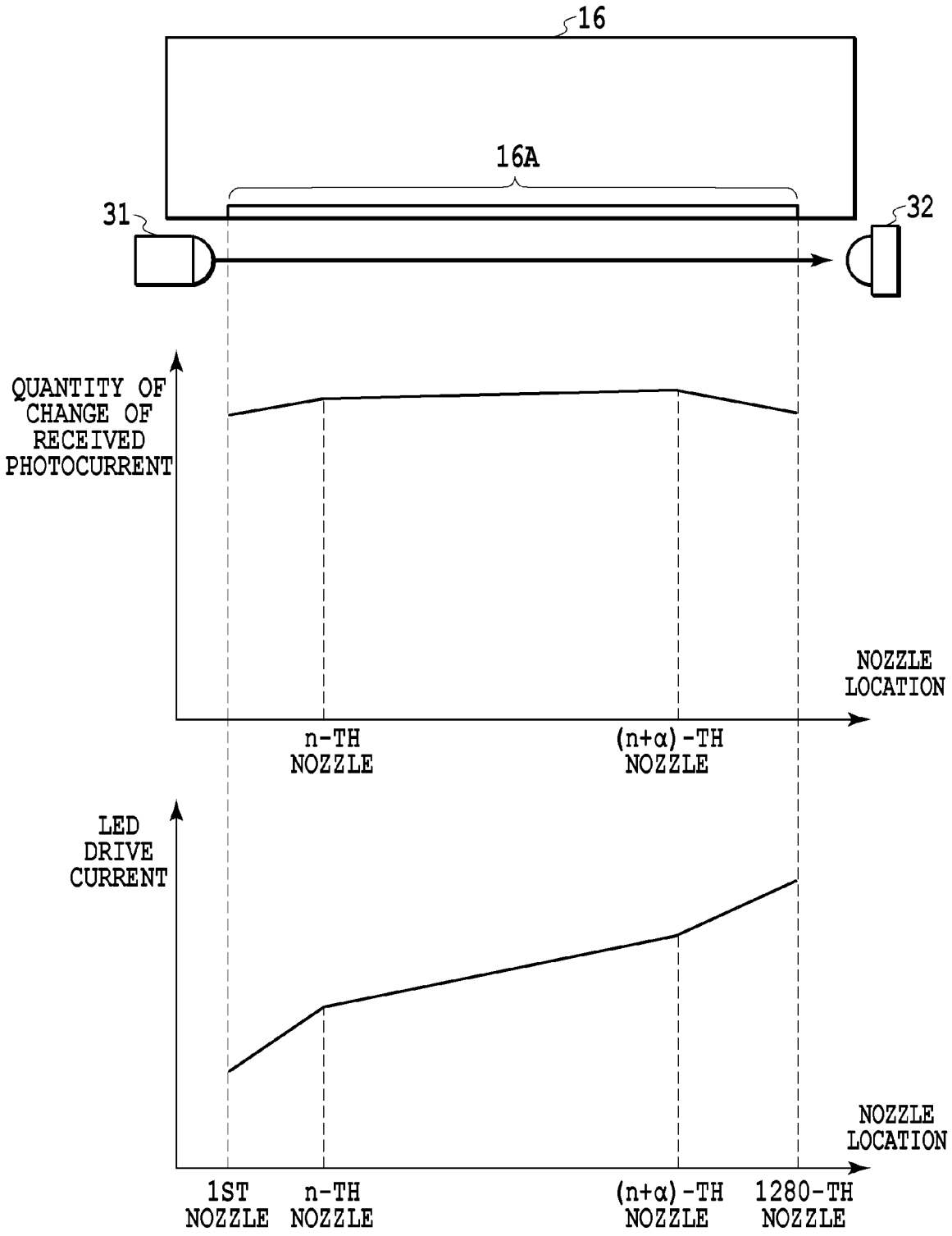
FIG. 12 is a schematic diagram showing a relationship between the locations of nozzles and changes in the quantities of received photocurrents and a relationship between the locations of nozzles and an LED drive current according to a modification of the first or the second embodiment.

In the first and second embodiments, the LED drive current has been maintained at the constant level for the nozzles included in the area intermediate between the other areas of the nozzle array 16A, i.e., for the area where the n-th to the $(n+\alpha)$-th nozzles are included. However, the present invention is not limited to this method, and as shown in FIG. 12, the emission intensity may be gradually increased in the area where the n-th to the $(n+\alpha)$-th nozzles belong.

Third Embodiment

A third embodiment of the present invention will now be described.

In the first or the second embodiment, the emission intensity of the light-emitting unit is changed in accordance with the location of a nozzle, for which the condition of ejection of a liquid should be detected. However, in the third embodiment, an ejection detection device 70 in FIG. 13 is employed to change the responsivity of a light-receiving unit based on the location of a nozzle to be examined without a change of the emission intensity of the light-emitting unit.

Figure 13:
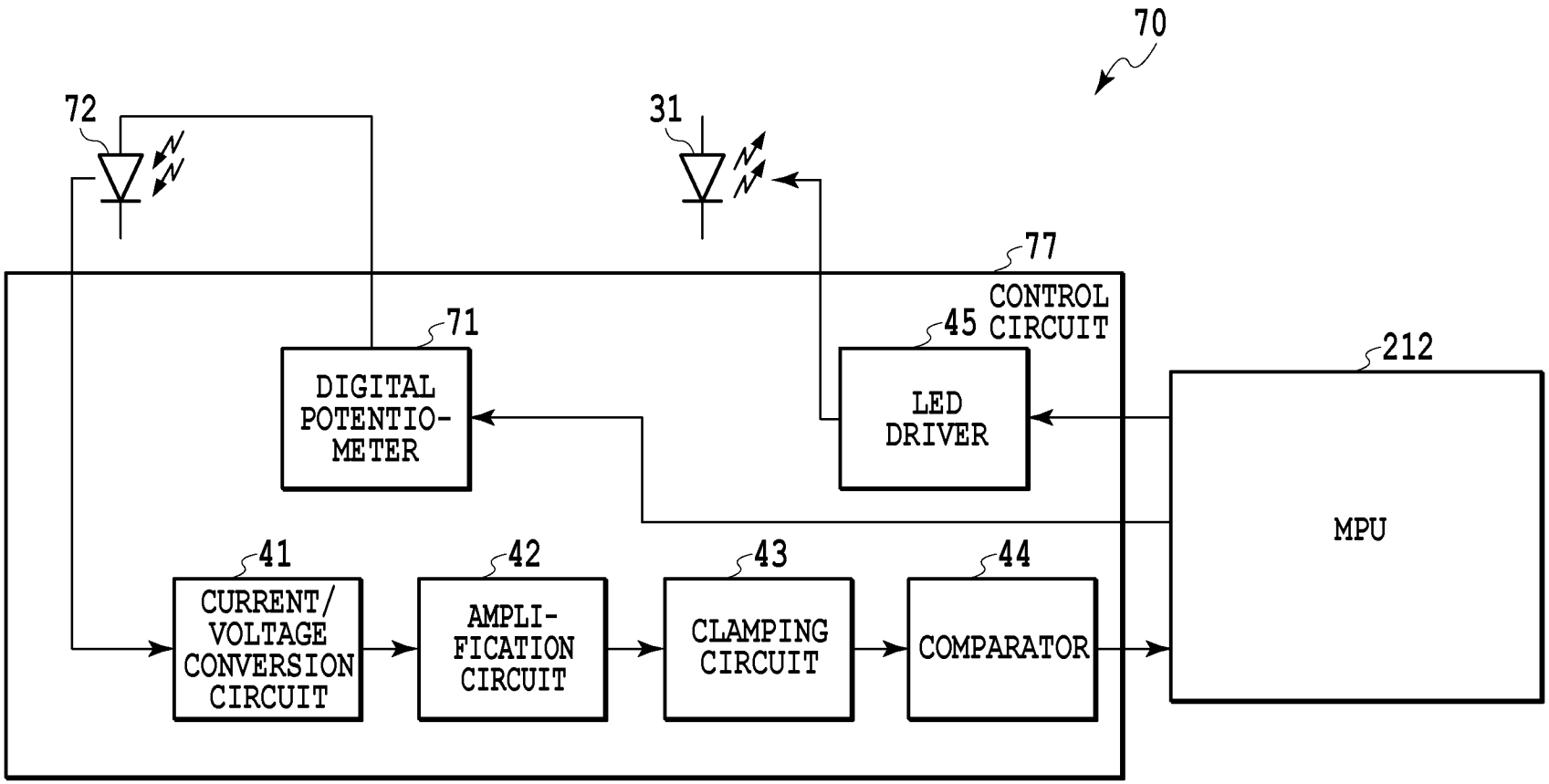
FIG. 13 is a block diagram showing the internal arrangement of the control circuit of an ejection detection device according to a third embodiment of the present invention.

For the third embodiment, an ejection detection device that includes a control circuit 70 is employed as a replacement of the ejection detection device for the first or the second embodiment, and the other arrangement is the same as that for the first embodiment. In FIG. 13, the same reference numerals are employed to denote the corresponding or identical components shown for the first or the second embodiment, and no further explanation for them will be given.

ejection detection device in FIG. 13 has a function that adjusts the responsibility of a photodiode (PD) by controlling a load resistance of a digital potentiometer 71 according to a control signal output from the MPU 212 in accordance with the location of a nozzle, the responsivity of a photodiode (PD) 72 serving as a light-receiving unit that receives light emitted by an LED 31 serving as a light-emitting unit. In this point, the third embodiment is different from the first and second embodiment.

In the third embodiment, both of the emission intensity of the light-emitting unit and the responsibility of the light-receiving unit may be adjusted. The responsivity of the photodiode 72 may be adjusted in accordance with the change of the intensity of light emitted by the LED 31. Further, the rate of the change of responsibility may also be adjusted in accordance with the location of a nozzle to be examined.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2013-039471, filed Feb. 28, 2013, 2014-027874, filed Feb. 17, 2014 which are hereby incorporated by reference herein in their entirety.

What is claimed is:

1. An ejection detection device, which employs a light-emitting unit to emit light toward liquid ejected from a plurality of nozzles, and based on the light received by a light-receiving unit, detects conditions of the nozzles, from which the liquid is ejected, comprising:

a control unit for controlling, in accordance with locations of the nozzles to be detected, an emission quantity of the light-emitting unit or a responsivity of the light-receiving unit.

2. The ejection detection device according to claim 1, wherein the control unit changes the emission quantity of the light-emitting unit or the responsivity of the light-receiving unit in accordance with the locations of the nozzles to be detected.

3. The ejection detection device according to claim 1, wherein when a nozzle to be detected of the plurality of nozzles is located more distant from the light-emitting unit, the control unit increases the emission quantity of the light-emitting unit or the responsivity of the light-receiving unit.

4. The ejection detection device according to claim 1, wherein when a nozzle to be detected of the plurality of nozzles is located closer to the light-emitting unit, the control unit reduces the emission quantity of the light-emitting unit or the responsivity of the light-receiving unit.

5. The ejection detection device according to claim 1, wherein when a nozzle to be detected of the plurality of nozzles is located closer to the light-emitting unit, the control unit reduces the emission quantity of the light-emitting unit or the responsivity of the light-receiving unit, and wherein, when a different predetermined nozzle to be detected is located more distant from the light-emitting unit than the predetermined nozzle, the control unit increases the emission quantity of the light-emitting unit or the responsivity of the light-receiving unit.

6. The ejection detection device according to claim 1, wherein the control unit adjusts a rate of changing the emission quantity or the responsivity in accordance with locations of the nozzles to be detected.

7. The ejection detection device according to claim 1, wherein the light-emitting unit includes a plurality of light-emitting devices, and wherein in accordance with whether a nozzle to be detected belongs to an area to be examined, the control unit changes the number of light-emitting devices, of the plurality of the light-emitting devices, for emission of light, thereby changing the emission quantity.

8. A printing apparatus for forming an image on a printing medium by ejecting a liquid from a plurality of nozzles that are arranged in a print head, comprising:

an ejection detection device according to claim 1.

9. A detection method, whereby light is emitted by a light-emitting unit toward liquid ejected from a plurality of nozzles, and based on the light received by a light-receiving unit, conditions of the nozzles, from which the liquid is ejected, are detected, comprising a step of: controlling, in accordance with locations of the nozzles to be detected, an emission quantity of the light-emitting unit or a responsivity of the light-receiving unit.

* * * * *